US010697722B2

(12) United States Patent
Kling et al.

(10) Patent No.: US 10,697,722 B2
(45) Date of Patent: Jun. 30, 2020

(54) SIDE-CHARGING UPPER FOR AR STYLE FIREARM

(71) Applicant: Acme Armament LLC, Londonderry, NH (US)

(72) Inventors: Adam P. Kling, Londonderry, NH (US); John Paris, Manchester, NH (US)

(73) Assignee: Acme Armament LLC, Londonderry, NH (US)

( * ) Notice: Subject to any disclaimer, the term of this patent is extended or adjusted under 35 U.S.C. 154(b) by 0 days.

(21) Appl. No.: 16/381,060

(22) Filed: Apr. 11, 2019

(65) Prior Publication Data

US 2019/0316859 A1 Oct. 17, 2019

Related U.S. Application Data

(60) Provisional application No. 62/657,823, filed on Apr. 15, 2018.

(51) Int. Cl.
*F41A 3/72* (2006.01)
*F41A 5/26* (2006.01)

(52) U.S. Cl.
CPC . *F41A 3/72* (2013.01); *F41A 5/26* (2013.01)

(58) Field of Classification Search
CPC ..... F41A 3/72; F41A 5/26; F41A 5/28
See application file for complete search history.

(56) References Cited

U.S. PATENT DOCUMENTS

| | | | | |
|---|---|---|---|---|
| 4,467,698 | A * | 8/1984 | Perrine | F41A 3/50 42/25 |
| 4,702,144 | A * | 10/1987 | Zedrosser | F41A 3/72 89/1.4 |
| 6,019,024 | A * | 2/2000 | Robinson | F41A 3/72 89/1.42 |
| 2013/0174457 | A1 | 7/2013 | Gangl et al. | |
| 2015/0226501 | A1 | 8/2015 | Gibbens et al. | |
| 2016/0348990 | A1* | 12/2016 | Steil | F41A 5/18 |
| 2018/0356171 | A1* | 12/2018 | Brown | F41A 3/26 |

* cited by examiner

*Primary Examiner* — Stephen Johnson
(74) *Attorney, Agent, or Firm* — Nicole D. Kling

(57) ABSTRACT

Described herein are side charging assemblies, side charging upper receiver assemblies, and/or upper receiver bodies for an AR style firearm and AR style firearms comprising the assemblies and/or bodies described herein.

14 Claims, 6 Drawing Sheets

SIDE-CHARGING UPPER FOR AR STYLE FIREARM

CROSS-REFERENCE TO RELATED APPLICATIONS

This application claims benefit under 35 U.S.C. § 119(e) of U.S. Application No. 62/657,823 filed Apr. 15, 2018, which is incorporated by reference herein in its entirety.

TECHNICAL FIELD

The invention relates generally to an upper receiver assembly for a weapon and more particularly to an upper receiver assembly with a side charging handle for an AR style firearm or similar weapon.

BACKGROUND

Currently, weapons are used for a variety of reasons from recreational use, to hunting and for tactical use by law enforcement and the like. In particular, rifles are a commonly owned weapon and used for various reasons. A rifle, such as an AR-15 or an AR-10, has the capability for use with multiple calibers of ammunition. In order to charge the weapon, conventional charging assemblies are located on the top of the weapon toward the rear of the upper receiver. This location requires movement from a typical shooting orientation of the weapon in order to charge it.

Accordingly, there is a need for an upper receiver that allows for a different location for a charging assembly. The assemblies described herein provide a charging assembly configured that does not require the user or firearm to move from the typical shooting orientation, while further providing improved performance and functionality of several aspects of existing charging assemblies.

SUMMARY

As described herein, the side charging assemblies provided herein permit charging of an AR style firearm without a need for the user or the firearm to be moved from a typical shooting orientation. Additionally, various elements of the assemblies described herein provide improved structural integrity, robust operation, and improved serviceability as compared to existing assemblies.

In some embodiments, provided herein is a side-charging assembly comprising a pull knob and charging hook for charging the bolt of an AR style firearm. The pull knob and charging hook are held in a forward position by means of a piston rod in contact with the charging hook, which is coupled to a push spring. The movement of the piston rod/push spring is further controlled by a piston rod guide tube and return spring.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures.

FIG. 1A depicts a right side view, FIG. 1B depicts a left side view, FIG. 1C depicts the lower and right side views, FIG. 1D depicts the upper and left side views, FIG. 1E depicts a front view, and FIG. 1F depicts a rear view.

FIG. 2A depicts the end of the pull knob furthest from the body of the firearm, FIG. 2B depicts the top or bottom view of the pull knob, FIG. 2C depicts the end of the pull knob closest to the body of the firearm.

FIG. 3B depicts a view of the pull knob connection face of the charging hook.

DETAILED DESCRIPTION

Figure 1A:
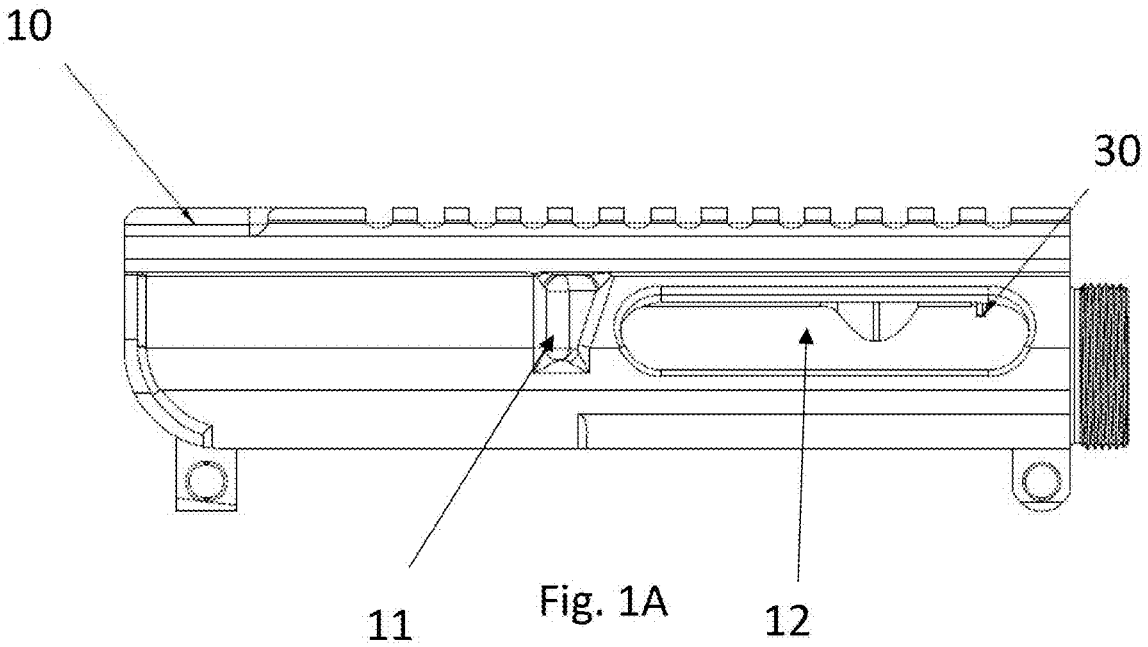
FIGS. 1A-1F depict various views of certain embodiments of a side-charging upper receiver assembly as described herein.
Figure 1B:
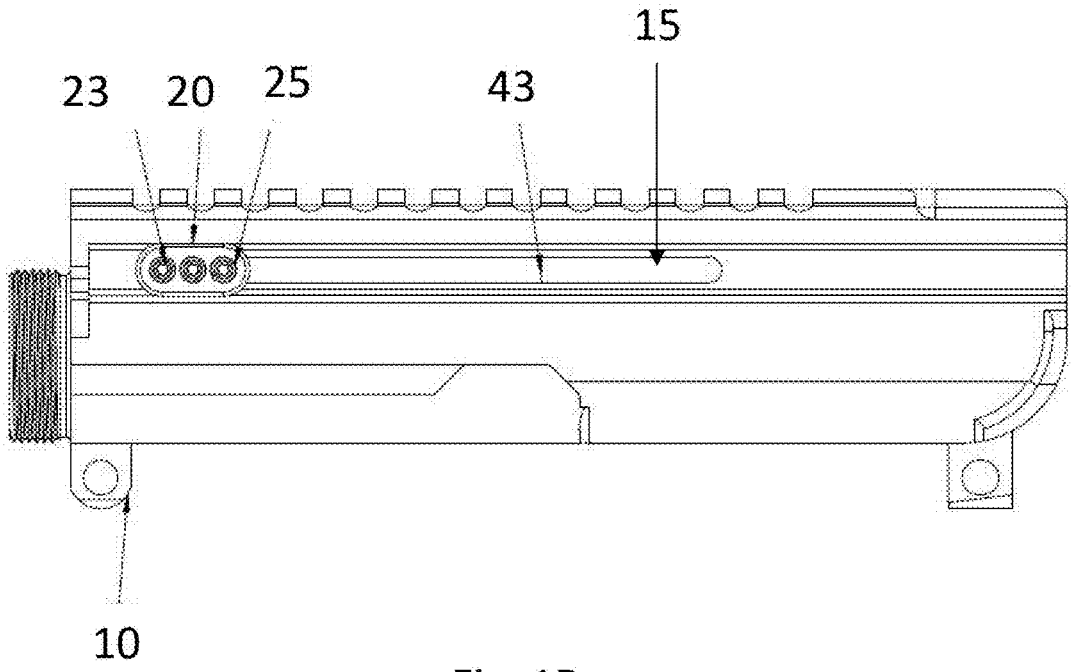
Figure 1C:
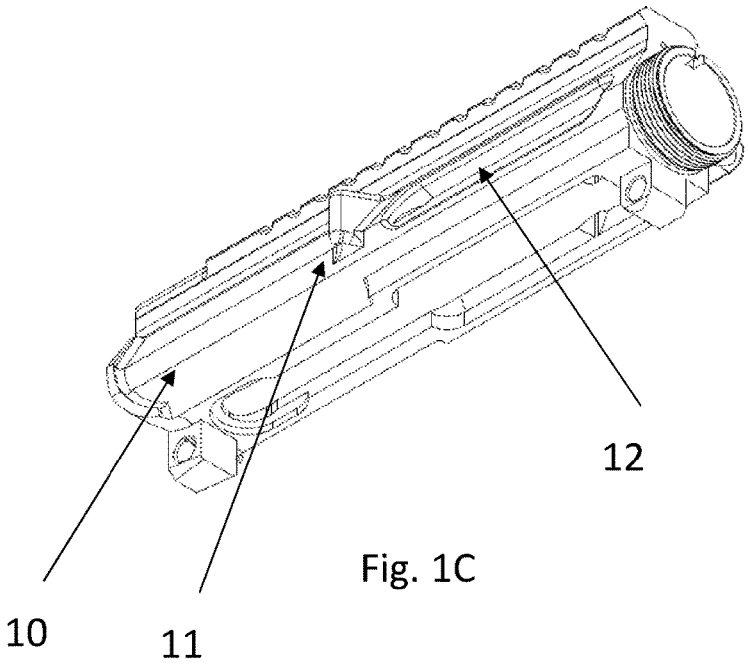
Figure 1D:
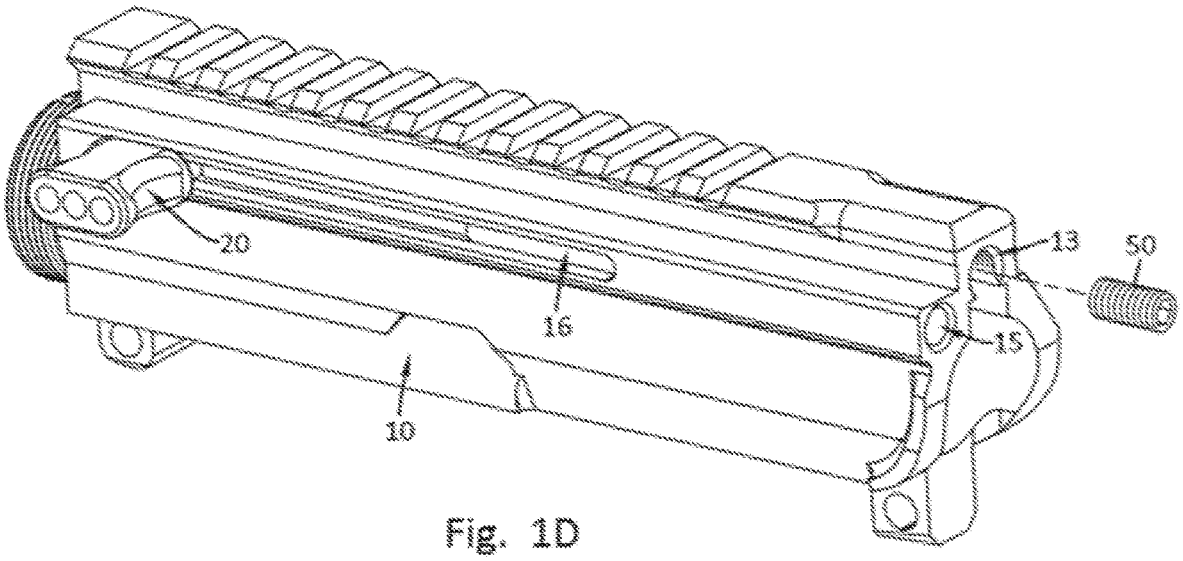
Figure 1E:
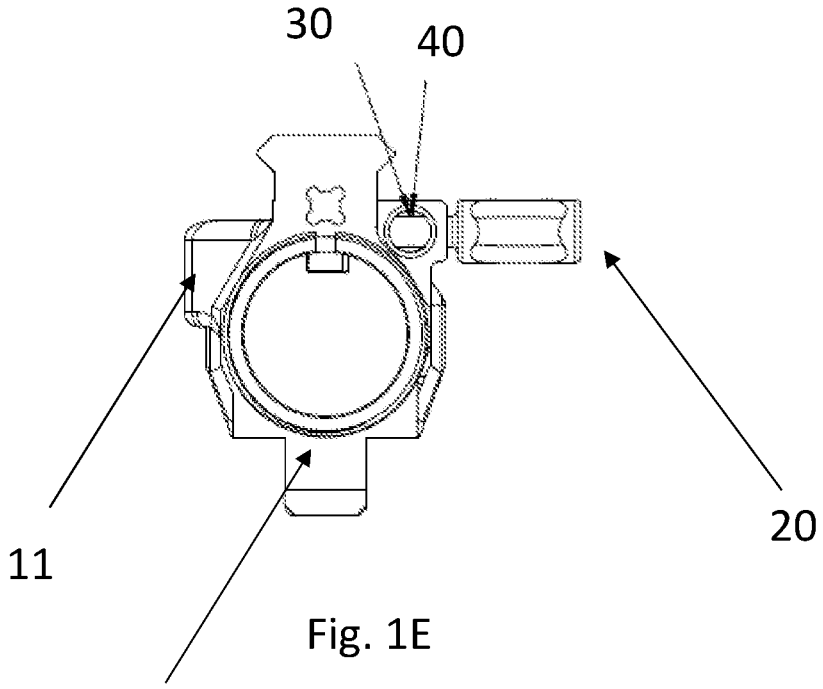
Figure 1F:
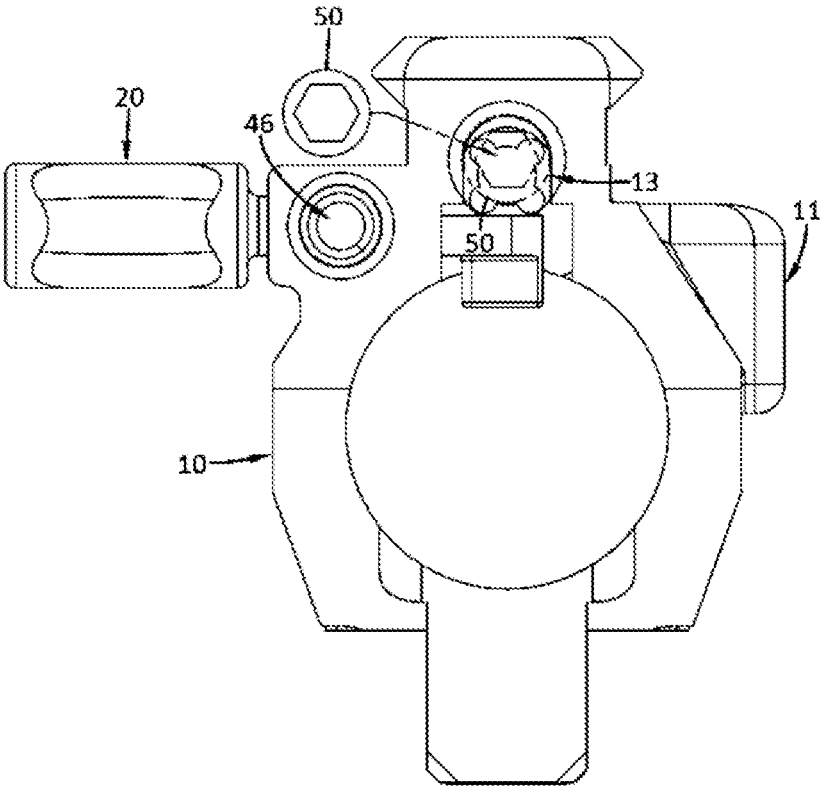

As discussed above, embodiments or the present invention relate to an upper receiver with a side charging handle for an AR style or similar firearm. AR style firearms can include the M16, AR10®, AR-15, M16A1, M16A2, M4A1, M16A1 and the like, including a large number of civilian model designations from various manufacturers. While an AR style firearm is most often a rifle, AR style handguns and shotguns exist, and the embodiments described herein can be utilized in, e.g., a rifle, a handgun, or a shotgun. As used herein, "upper receiver assembly" refers to an assembly of an AR style firearm comprising at least 1) an upper receiver body, which is the frame for the upper receiver and 2) one or both of i) a charging assembly and ii) a bolt carrier group.

Referring to the drawings, FIGS. 1A-1F depict certain illustrative embodiments of a side-charging upper receiver assembly as described herein. The upper receiver assembly comprises an upper receiver body 10, and a side charging assembly. In the embodiment of the upper receiver body 10 depicted, the upper receiver body comprises a deflector 11, which is positioned rearward of the ejection port 12 on the exterior side of the upper receiver body. The upper receiver body 10 depicted further comprises a channel opening 16 formed in a side of the body 15, to permit communication and movement of the side charging assembly's pull knob 20 and charging hook 30.

Upper receiver bodies for AR style rifles comprise a gas key channel 13 on the top interior of the upper receiver body. In a rear-charging style upper receiver, the charging handle rides in the rear portion of the gas key channel and when locked in its forward position, the rear-charging charging handle serves to close the rear opening of the gas key channel A side-charging upper receiver's charging assembly is provided in another location in the upper receiver assembly, and thus an alternative means for closing the rear opening of the gas key channel can be provided. Earlier AR style designs rely upon doors (including spring-loaded doors) or exterior-mounted screws. Such mechanisms may not align optimally with all lower receivers and necessarily involve the use of small parts which are more susceptible to breakage or loss during service of the rifle. In some embodiments of any of the aspects, the upper receiver body 10 described herein comprises threads 14 in the rear end of the gas key channel 13. The threads permit the insertion of a screw, e.g., a set screw 50 in the rear opening of the gas key channel 13, whereby the rear opening of the gas key channel 13 is closed. Such an embodiment provides secure closure of the gas key channel 13 with increased robustness as compared to earlier AR style designs.

Figure 2A:
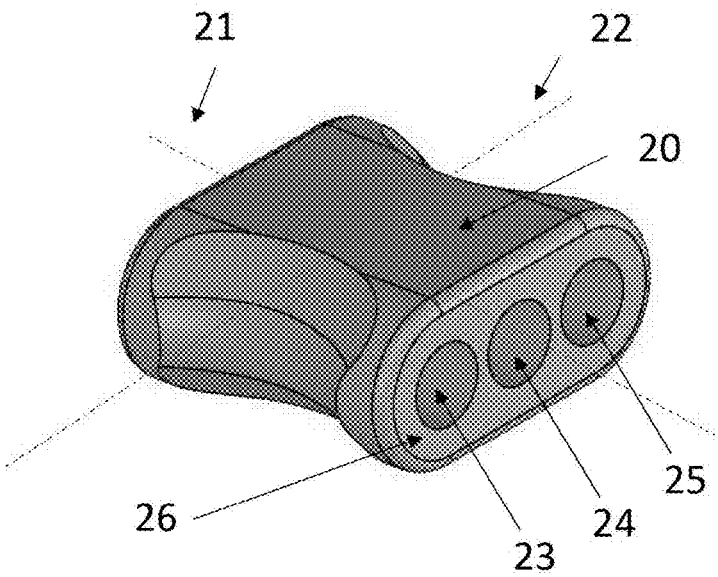
FIGS. 2A-2C depict various views of certain embodiments of a pull knob as described herein.
Figure 2B:
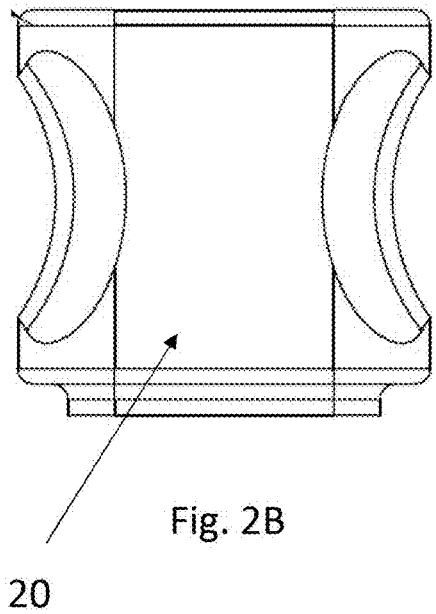
Figure 2C:
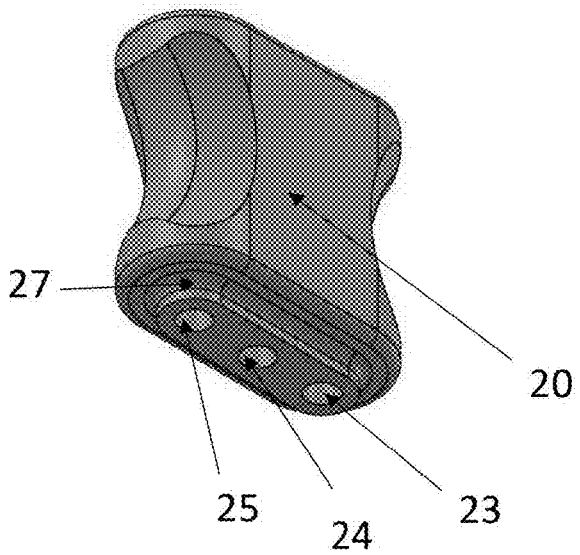

FIGS. 2A-2C depict illustrative embodiments of pull knobs as described herein. The pull knob 20 has a first axis 21 substantially perpendicular to the bore axis of the firearm and a second axis 22 substantially parallel to the bore axis of the firearm. Three channels 23, 24, 25 are located in the pull knob 20, extending the length of the pull knob, e.g., from one end of the pull knob to the other, on the first axis 21. In some embodiments of any of the aspects, the three channels 23, 24, 25 can be the same diameter with the forward 23 and rearward channels 25 each located the same distance from the center channel 24. In some embodiments of any of the aspects, the three channels 23, 24, 25 do not comprise threading.

The faces 26, 27 of the pull knob 20 on the first axis 21 can be substantially elliptical, e.g., with the pull knob 20 being longer front to back than it is tall from bottom to top. The exterior profile of the pull knob 20 on the second axis 22 can be concave on at least a portion of the forward and/or rearward edges, e.g., as depicted in FIG. 2B. In some embodiments of any of the aspects, the exterior profile of the pull knob 20 on the second axis 22 is concave on at least a portion of the forward and rearward edges. Concavity of the forward and/or rearward edges of the pull knob 20 can provide enhanced ergonomics and more secure operation of the pull knob compared to, e.g., round pull knobs.

Figure 3:
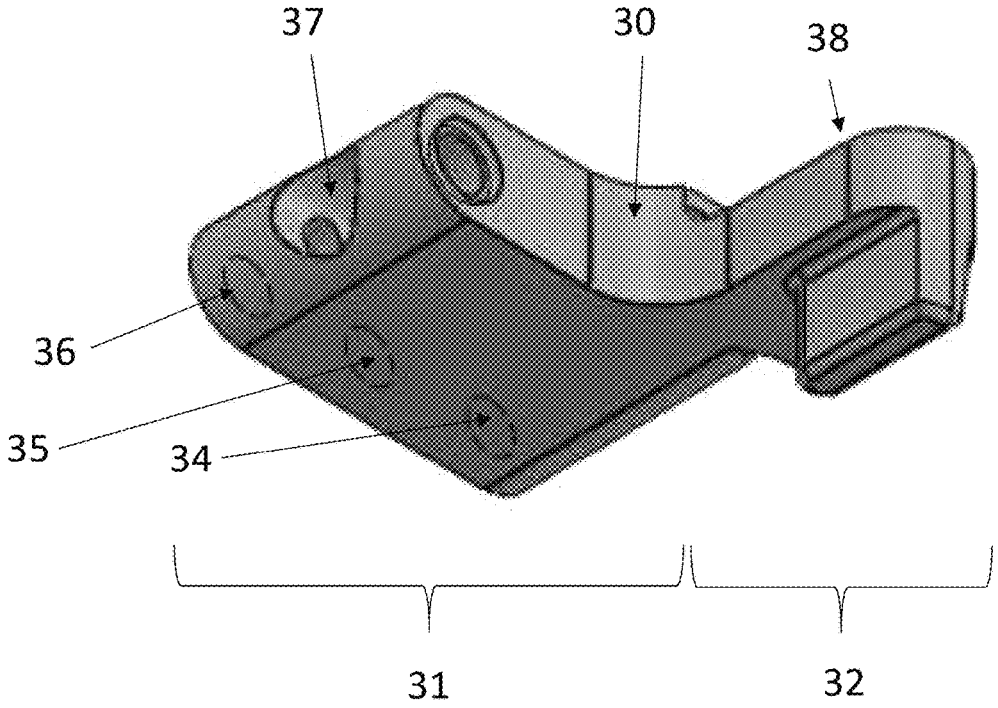
FIG. 3 depicts a certain embodiment of a charging hook as described herein. The view of the charging hook is from below and to the rear.

FIG. 3 depict an illustrative embodiment of certain charging hooks as described herein. The charging hook 30 is a single continuous part which can be conceptually divided into the charging hook body 31 and the bolt carrier connection portion 32. The charging hook body 31 connects the charging hook 30 to the pull knob 20 and the piston rod 40. In some embodiments, the charging hook body 31 comprises a pull knob connection face 33 which comprises three channels 34, 35, 36 which are at least partially threaded. In some embodiments of any of the aspects, the three channels 34, 35, 36 are threaded for their entire length. In some embodiments of any of the aspects, the three channels 34, 35, 36 are threaded for a portion of their length. The charging hook body 31 can further comprise a piston rod channel 37 opening on the rearward surface of the charging hook body 31. In some embodiments, the piston rod channel 37 is not threaded. In some embodiments, the piston rod channel 37 and the most rearward of the three channels 36 of the pull knob connection face 33 can intersect.

The bolt carrier connection portion 32 of the charging hook 30 is configured to engage the charging handle contact point of a bolt carrier. In some embodiments, the bolt carrier connection portion 32 has a flat upper edge 38. The flat upper edge 38 of the bolt carrier connection portion 32 can provide a stronger part, e.g., as compared to earlier designs which feature a cut around the gas key.

In some aspects of any of the embodiments, described herein is a side charging assembly for an AR style firearm, the assembly comprising: a) a pull knob 20 having a first axis substantially perpendicular to the bore axis of the firearm and a second axis substantially parallel to the bore axis of the firearm; wherein the pull knob 20 comprises 3 channels 23, 24, 25 which extend the length of the pull knob 20 on the first axis; wherein the faces of the pull knob 26, 27 on the first axis are substantially elliptical; and wherein the exterior profile of the pull knob on the second axis is concave on at least a portion of the forward and/or rearward edges; and b) a charging hook 30 comprising i) a charging hook body 31 comprising: a pull knob connection face 33, comprising 3 threaded channels 34, 35, 36; and a piston rod channel 37 on the rearward surface of the body of the charging hook; and ii) a bolt carrier connection portion 32 configured to engage the charging handle contact point of a bolt carrier. In some aspects of any of the embodiments, described herein is a side charging assembly for an AR style firearm, the assembly comprising: a) a pull knob 20 having a first axis substantially perpendicular to the bore axis of the firearm and a second axis substantially parallel to the bore axis of the firearm; wherein the pull knob 20 comprises 3 channels 23, 24, 25 which extend the length of the pull knob on the first axis; wherein the faces of the pull knob 26, 27 on the first axis are substantially elliptical; and wherein the exterior profile of the pull knob on the second axis is concave on at least a portion of the forward and/or rearward edges; b) a charging hook 30 comprising i) a charging hook body 31 comprising: a pull knob connection face 33, comprising 3 threaded channels 34, 35, 36; and a piston rod channel 37 on the rearward surface of the body of the charging hook; and ii) a bolt carrier connection portion 32 configured to engage the charging handle contact point of a bolt carrier; c) three screws for attaching the pull knob 20 and charging hook 30 by means of each screw extending from a channel 23, 24, 25 in the pull knob 20 into a channel 34, 35, 36, of the charging hook. In some embodiments of any of the aspects, the side charging assembly can further comprise three washers, e.g., to be placed around the body of each screw within a channel 23, 24, 25 in the pull knob.

Notably, as compared to earlier pull knob designs, the embodiments described herein do not comprise a detent in the side charging assembly. Earlier pull knobs relied up a detent between the pull knob and the upper receiver body to hold the pull knob in a forward position. Removal of this detent, e.g., by use of the piston rods and springs described elsewhere herein permits the pull knob to be held in the forward position more securely and avoids the use of small parts which complicate servicing of the mechanism and which are readily lost during same. In some embodiments of any of the aspects, the side charging assembly does not comprise a detent in the pull knob. In some embodiments of any of the aspects, the side charging assembly does not comprise a detent which engages the pull knob with an upper receiver body.

Figure 4:
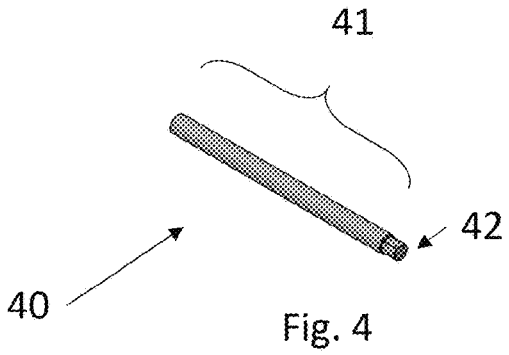
FIG. 4 depicts an embodiment of a piston rod as described herein.

In some embodiments, the side charging assembly can further comprise a piston rod 40, piston guide tube 43, push spring 45, and return spring 47. FIG. 4. depicts an illustrative embodiment of certain piston rods as described herein. The piston rod 40 comprises a solid cylindrical body 41 and a rear portion 42 comprising a smaller diameter solid cylinder. The end of the front end of the piston rod 40 is configured to be inserted into the piston rod channel 37 of the charging hook 30. In some embodiments of any of the aspects, neither the front end of the piston rod 40 or the piston rod channel 37 of the charging hook 30 are threaded. Earlier designs captured the piston rod between the charging hook and the pull knob. The embodiments described herein, wherein the piston rod contacts the piston rod channel 37 of the charging hook 30 provide a more solid contact between the charging hook 30 and the pull knob 20.

Figure 6:
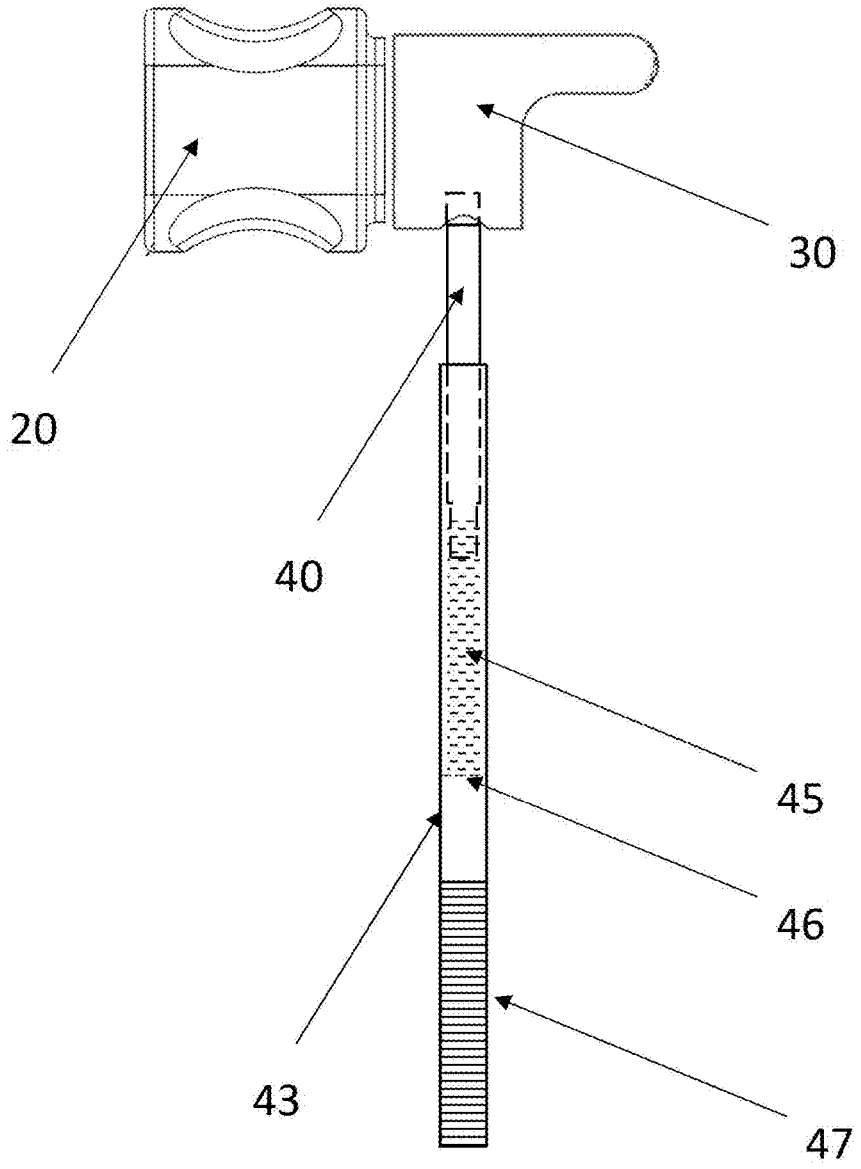
FIG. 6 depicts a diagram of how the pull knob, charging hook, piston rod, piston rod guide tube, return spring, and push spring are oriented with respect to each other in an assembled configuration. The diagram is not necessarily to scale and is intended merely to show the relative position of the parts.

The rear end of the piston rod 40, which comprises the rear portion 42, is configured to be inserted into a piston rod guide tube 43, as depicted in the diagram provided in FIG. 6. The piston rod guide tube 43 is a hollow cylindrical body having an interior piston rod channel 44. The piston rod channel 44 of the piston rod guide tube is configured to a) accept the piston rod 40 and a push spring 45 in the front of the cylindrical body of the piston guide tube and b) to operably connect to a return spring 47 at the rear of the rear of the piston rod guide tube 43. The springs described herein can be coil springs.

Figure 5:
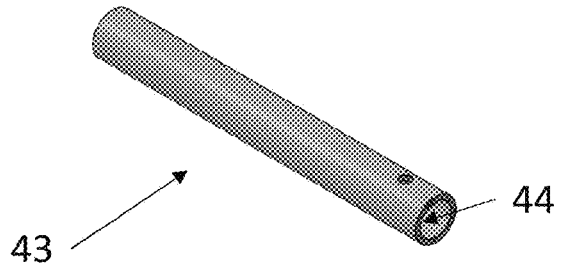
FIG. 5 depicts an embodiment of a piston rod guide tube as described herein, from the rear and side.

In certain embodiments, in an operating configuration, the push spring 45 and the rear end of the piston rod 40 are located inside the piston rod channel 44 of the piston guide tube 43. Additionally, the push spring 45 is captured on the rear portion 42 of the piston rod 40, whereby the push spring exerts force to hold the piston rod 40 in a forward position relative to the piston guide tube 43. In order for this force to be exerted, a retaining mechanism must be provided to contact the rear end of the push spring 45. In some embodiments of any of the aspects, the piston guide tube 43 comprises a closed rear face to contact and/or retain the push spring 45. In some embodiments of any of the aspects, the piston guide tube 43 comprises an obstruction 46 (complete or partial) within the piston rod channel 44 to contact and/or retain the push spring 45. In some embodiments, the obstruction 46 can be located within a piston rod channel 44 that would otherwise extend the length of the piston guide tube 43. In some embodiments, the obstruction 46 can be located within a piston rod channel 44 such that the piston rod channel 44 terminates at the obstruction and the remaining rear portion of the piston rod guide tube 43 is a solid cylinder. In some embodiments, e.g., as illustrated in FIG. 5, the piston guide tube 43 comprises two holes in the cylindrical body and a pin 46 extending between the two holes, thereby forming an obstruction 46 to contact and/or retain the rear end of the push spring 45. In some embodiments of any of the aspects, the pin 46 is a roll pin.

In some embodiments, in an operating configuration, the forward edge of the return spring 47 contacts the piston rod guide tube 43 and the rear edge of the return spring 47 contacts the upper receiver body 10, thereby exerting a force to hold the piston rod guide tube 43, the piston rod 40, the charging hook 30, and the pull knob 20 in the forward position. In some embodiments of any of the aspects, in an operating configuration, the front of the return spring 47 makes contact with the rear face of the piston rod guide tube 43. In some embodiments of any of the aspects, in an operating configuration, the front of the return spring 47 located within the piston rod channel 44 and makes contact with the rear of the obstruction 46 in the piston rod channel 44 of the piston rod guide tube 43.

In some embodiments, the upper receiver body 10, comprises a piston channel 15 along the side wall of the upper receiver body 10 extending along the axis of the upper receiver body 10 parallel with the bore axis. In an operating configuration, the piston rod 40, piston rod guide tube 43, push spring 45, and return spring 47 are located within this piston channel 15. The piston channel 15 can pierce the front and/or rear exterior walls of the upper receiver body 10, and can retain the piston rod 40, piston rod guide tube 43, push spring 45, and return spring 47 by means of being threaded and accepting a screw at a terminus (or termini) of the piston channel 15. In some embodiments of any of the aspects, an upper receiver assembly described herein can further comprise one or more screws configured to close the threaded terminus (or termini) of the piston channel 15.

The upper receiver assemblies described herein can include other conventional parts that are not specifically discussed in this disclosure and therefor in at least this way, the upper receiver assemblies described herein may fully replace a conventional upper receiver assembly of an AR style firearm. By way of non-limiting example, an upper receiver assembly described herein can comprise a gas port aperture. The gas port aperture operates to allow a gas port to extend into the upper receiver assembly. In embodiments, the gas port aperture includes a gas port set screw mounted within the gas port aperture. A gas tube of the firearm extends into the upper receiver assembly through the set screw to engage a gas key or the bolt carrier.

In one aspect of any of the embodiments, described herein is a side-charging upper receiver assembly for an AR style firearm, comprising: a) an upper receiver body 10 with a channel opening 16 formed in a side of the body; b) a bolt carrier group operatively coupled within the upper receiver body 10; and c) a side charging assembly described herein, thereby providing a pull knob 20 that extends through the channel opening 16 of the upper receiver body 10 and which moves the bolt carrier group toward the buttstock of the firearm in response to the pull knob 20 being moved toward the buttstock of the firearm. A bolt carrier group refers to an assembly comprising a bolt, a gas key, a bolt carrier, a firing pin, firing pin spring, extractor, cam pin, extractor spring, ejector spring, ejector, firing retaining pin, gas ring(s), extractor pin, ejector roll pin, or the equivalent(s) thereof. Bolt carrier groups for various chamberings are readily available commercially.

In one aspect of any of the embodiments, described herein is an AR style firearm comprising: a) a lower receiver b) buttstock or equivalent thereof coupled to the lower receiver; c) a trigger operatively coupled within the lower receiver; c) a barrel; and d) an upper receiver assembly as described herein. The upper receiver assemblies described herein can be coupled to the other elements of an AR style firearm by any method known in the art. For example, a lower receiver is typically coupled to an upper receiver by means of two pins, e.g., a front pin and rear pin. The firearm can further comprise a forearm, gas system, sights, rails or accessory attachment points, one or more grips, and the like, e.g, any parts or assemblies which are conventionally used in AR style firearms. Various alternative lower receivers, buttstocks, trigger assemblies, barrels, etc are well known in the art and readily available commercially.

As used herein, "assembly" refers to two or more parts that, when in their operating configurations as part of a firearm, are operably connected and interact to accomplish or more functions. An assembly can exist in that operating configuration, or another configuration, e.g., packaged for sale as a set or kit.

As used herein, terms describing relative directions or orientations (e.g., front, back/rear, distal, proximate, top/upper, bottom/lower) of various elements are used in reference to the perspective of a user holding a firearm. Thus used herein, the terms "rear" and "rearward" and "front" and "forward" have the following definitions: "rear" or "rearward" means in the direction away from the muzzle of the firearm while "front" or "forward" means in the direction towards the muzzle of the firearms. Likewise, for example, the top/upper edge or surface of a component refers to that edge or surface of the component that is nearest or facing the top of the firearm when the component is properly installed in the firearm and the firearm is held in a normal firing position. Finally, for example, the bottom/lower edge or surface of a component refers to that edge or surface of the component that is nearest or facing the bottom of the firearm when the component is properly installed in the firearm and the firearm is held in a normal firing position.

Firearms can be designed with ejection ports on either the right or left side of the firearm. The embodiments described and depicted here are right-hand configurations, e.g., configured for a user that uses their right hand to operate the trigger mechanism of the firearm. Specifically contemplated herein are left-hand configurations of all of the embodiments, e.g., configured for a user that uses their left hand to operate the trigger mechanism. Left-handed versions of the parts and/or assemblies described herein are readily provided as "mirror images" of the right-handed parts and/or assemblies. Left-handed versions of existing AR style firearms and portions thereof are known in the art.

Further, the embodiments described herein can be utilized in an AR style firearm of any caliber. In the present figures, dimensions are provided for an AR style chambered for typically rifle cartridges, purely as an exemplary embodiment. From these dimensions, and the relation of prior art AR style firearms in various chamberings, the necessary dimensions for any desired chambering are readily determined by one of skill in the art.

A screw can be any type or size screw that can be installed into the provided threads. In many cases, a screw is interested to that none of the screw protrudes from the part it is installed in. Alternatively, part of the screw may protrude, e.g., in order to assist in removal. A screw can be, e.g., a set screw, flat, plain cup, hex, or Allen head cap. A screw may be manufactured from any suitable material that is capable of withstanding the forces generated during firing, for example, stainless steel. The length of the screw may vary depending on the dimensions of any interfacing components, but should minimally be designed to that the number of threads engaged is sufficient to withstand the applied loading.

The components and/or assemblies described herein, e.g., of a side charging assembly or upper receiver assembly can be formed of any or many different types or materials or combinations thereof that can readily be formed into shaped objects provided that the components selected are consistent with the intended operation or an upper receiver assembly. For example, the components may be formed of: rubbers (synthetic and/or natural) and/or other like materials; glasses (such as fiberglass) carbon-fiber, aramid fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof. The components may also optionally be coated or treated, e.g., parkerization, CERAKOTE™, DURACOAT™, titanium nitride, nickel-boron (NiB), black nitride, phosphate coating, chrome-plating, ROBAR™ NP3, blueing, melonite, NiCorr, anodizing, Ferritic Nitrocarburizing, TENNIFER™, GUNKOTE™, or the like.

Furthermore, the components defining any upper receiver assembly may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

As used herein, the term "comprising" means that other elements can also be present in addition to the defined elements presented. The use of "comprising" indicates inclusion rather than limitation.

The singular terms "a," "an," and "the" include plural referents unless context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The abbreviation, "e.g." is derived from the Latin exempli gratia, and is used herein to indicate a non-limiting example. Thus, the abbreviation "e.g." is synonymous with the term "for example."

The description of embodiments of the disclosure is not intended to be exhaustive or to limit the disclosure to the precise form disclosed. While specific embodiments of, and examples for, the disclosure are described herein for illustrative purposes, various equivalent modifications are possible within the scope of the disclosure, as those skilled in the relevant art will recognize. While a current embodiment of a firearm with a side charging assembly has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Furthermore, while advantages associated with certain embodiments of the disclosure have been described in the context of these embodiments, other embodiments may also exhibit such advantages, and not all embodiments need necessarily exhibit such advantages to fall within the scope of the disclosure.

What is claimed herein is:

1. A side charging assembly for an AR style firearm, the assembly comprising:

a. a pull knob having a first axis substantially perpendicular to a bore axis of the firearm and a second axis substantially parallel to the bore axis of the firearm;
wherein the pull knob comprises 3 channels which extend the length of the pull knob on the first axis;
wherein the pull knob comprises faces on the first axis that are substantially elliptical; and
wherein an exterior profile of the pull knob on the second axis is concave on at least a portion of a forward and/or rearward edge of the pull knob; and b. a charging hook comprising
i. a charging hook body comprising:
1. pull knob connection face, comprising 3 threaded channels;
2. a piston rod channel on a rearward surface of the charging hook body; and
ii. a bolt carrier connection portion configured to engage a charging handle contact point of a bolt carrier.

2. The side charging assembly of claim 1, wherein the bolt carrier connection portion has a flat upper edge.

3. The side charging assembly of claim 1, wherein the 3 channels of the pull knob do not comprise threading.

4. The side charging assembly of claim 1, wherein the exterior profile of the pull knob on the second axis is concave on at least a portion of both the forward and rearward edges.

5. The side charging assembly of claim 1, further comprising:

c. a piston rod comprising a solid cylindrical body and rear portion comprising a smaller solid cylinder;

d. a piston guide tube comprising
i. a cylindrical body;
ii. an interior piston rod channel, configured to accept the piston rod and a push spring in a front of the cylindrical body of the piston guide tube;

e. the push spring located inside the piston rod channel of the piston guide tube and captured on the rear portion of the piston rod, whereby the push spring exerts force to hold the piston rod in a forward position relative to the piston guide tube; and f. a return spring positioned rearward of the piston guide tube which exerts force to hold the piston rod guide tube, the piston rod, the charging hook, and the pull knob in the forward position.

6. The side charging assembly of claim 5, wherein the piston guide tube comprises a closed rear face to retain the push spring.

7. The side charging assembly of claim 5, wherein the piston guide tube comprises two holes in the cylindrical body and a pin extending between the two holes to retain the push spring.

8. The side charging assembly of claim 7, wherein the pin is a roll pin.

9. The side charging assembly of claim 1, wherein the side charging assembly does not comprise a detent in the pull knob.

10. The side charging assembly of claim 1, wherein the side charging assembly does not comprise a detent which engages the pull knob with an upper receiver body.

11. A side-charging upper receiver assembly for an AR style firearm, the side-charging upper receiver assembly comprising:

a. an upper receiver body with a channel opening formed in a side of the body;

b. a bolt carrier operatively coupled within the upper receiver body;

c. a bolt coupled within the bolt carrier;

d. the side charging assembly of claim 1, whereby the pull knob that extends through the channel opening of the upper receiver body and which moves the bolt carrier toward a butt stock of the firearm in response to the pull knob being moved toward the butt stock of the firearm.

12. The upper receiver assembly of claim 11, wherein the upper receiver body further comprises a gas key channel wherein the rear end of the gas key channel comprises threads to accept a set screw.

13. The upper receiver assembly of claim 12, further comprising the set screw engaged in the threads.

14. The upper receiver assembly of claim 11, further comprising a deflector rearward of an ejection port on an exterior side of the upper receiver body.

* * * * *